US011035201B2

(12) United States Patent
Frazier et al.

(10) Patent No.: US 11,035,201 B2
(45) Date of Patent: Jun. 15, 2021

(54) HYDROCARBON WELLS INCLUDING ELECTRICALLY ACTUATED GAS LIFT VALVE ASSEMBLIES AND METHODS OF PROVIDING GAS LIFT IN A HYDROCARBON WELL

(71) Applicants: Christopher C. Frazier, Midland, TX (US); Ted A. Long, Spring, TX (US); Dustin H. Rose, Odessa, TX (US); Joseph Salviz, Midland, TX (US); Michael C. Romer, The Woodlands, TX (US); Anthony J. Bermea, Midland, TX (US); Billy-Bob Walker, Midland, TX (US)

(72) Inventors: Christopher C. Frazier, Midland, TX (US); Ted A. Long, Spring, TX (US); Dustin H. Rose, Odessa, TX (US); Joseph Salviz, Midland, TX (US); Michael C. Romer, The Woodlands, TX (US); Anthony J. Bermea, Midland, TX (US); Billy-Bob Walker, Midland, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 41 days.

(21) Appl. No.: 16/437,547

(22) Filed: Jun. 11, 2019

(65) Prior Publication Data

US 2020/0063525 A1 Feb. 27, 2020

Related U.S. Application Data

(60) Provisional application No. 62/769,307, filed on Nov. 19, 2018, provisional application No. 62/720,486, filed on Aug. 21, 2018.

(51) Int. Cl.

| | |
|---|---|
| ***E21B 34/08*** | (2006.01) |
| ***E21B 34/06*** | (2006.01) |
| ***E21B 43/12*** | (2006.01) |

(52) U.S. Cl.

CPC ..... *E21B 34/08* (2013.01); *E21B 34/066* (2013.01); *E21B 43/123* (2013.01); *E21B 34/06* (2013.01); *E21B 43/12* (2013.01); *E21B 43/122* (2013.01)

(58) Field of Classification Search

CPC ..... E21B 34/08; E21B 34/066; E21B 43/123; E21B 43/12; E21B 34/06; E21B 43/122

See application file for complete search history.

(56) References Cited

U.S. PATENT DOCUMENTS 5,425,425 A * 6/1995 Bankston ..... E21B 23/03 166/117.5

6,148,843 A * 11/2000 Pringle ..... E21B 34/066 137/155

(Continued)

*Primary Examiner* — Tara Schimpf

*Assistant Examiner* — Manuel C Portocarrero

(74) *Attorney, Agent, or Firm* — Leandro Arechederra, III

(57) ABSTRACT

Hydrocarbon wells including electrically actuated gas lift valve assemblies and methods of providing gas lift in a hydrocarbon well. The hydrocarbon wells include a wellbore that extends within a subterranean formation and downhole tubing that extends within the wellbore. The hydrocarbon wells also include a lift gas supply system configured to provide a lift gas stream to a lift gas supply conduit of the wellbore, a plurality of electrically actuated gas lift valve assemblies, a valve power supply system, and a controller. The methods include measuring a respective pressure differential between a lift gas supply conduit and a production conduit of the hydrocarbon well at each electrically actuated gas lift valve assembly in a plurality of electrically actuated gas lift valve assemblies of the hydrocarbon well. The methods also include selectively opening a (Continued)

selected electrically actuated gas lift valve assembly based on the respective pressure differential.

14 Claims, 3 Drawing Sheets

(56) References Cited

U.S. PATENT DOCUMENTS

| | | | | |
|---|---|---|---|---|
| 8,424,599 | B2 * | 4/2013 | Atencio | E21B 43/12 166/250.15 |
| 8,925,638 | B2 | 1/2015 | Wygnanski | |
| 9,453,389 | B2 | 9/2016 | Anderson et al. | |
| 2009/0014672 | A1 * | 1/2009 | Schiemann | F01L 9/02 251/129.01 |
| 2017/0183955 | A1 * | 6/2017 | Peacock | E21B 47/07 |
| 2017/0314374 | A1 * | 11/2017 | Lundberg | F16K 17/30 |

* cited by examiner

HYDROCARBON WELLS INCLUDING ELECTRICALLY ACTUATED GAS LIFT VALVE ASSEMBLIES AND METHODS OF PROVIDING GAS LIFT IN A HYDROCARBON WELL

CROSS-REFERENCE TO RELATED APPLICATION

This application claims the benefit of U.S. Provisional Patent Application 62/720,486 filed Aug. 21, 2018 and U.S. Provisional Patent Application 62/769,307 filed Nov. 19, 2018, the entirety of both of which are incorporated by reference herein.

FIELD OF THE DISCLOSURE

The present disclosure relates generally to hydrocarbon wells including electrically actuated gas lift valve assemblies and to methods of providing gas lift in a hydrocarbon well.

BACKGROUND OF THE DISCLOSURE

Some hydrocarbon wells do not have enough reservoir pressure to transport reservoir fluids from a subterranean region to a surface region and/or to transport the reservoir fluids at an economically viable flow rate. In such hydrocarbon wells, artificial lift may be utilized to facilitate and/or increase production of the reservoir fluids from the hydrocarbon wells. Various artificial lift methodologies exist, including hydraulic pumping systems, electric submersible pumps, rod pumps, and/or gas lift, and each of these methodologies may be particularly well-suited for certain corresponding hydrocarbon well configurations.

Gas lift methodologies generally utilize a series of mechanically actuated gas lift valves spaced-apart along a length of the hydrocarbon well. These mechanically actuated gas lift valves are configured to inject a high-pressure gas stream into the hydrocarbon well. The high-pressure gas stream decreases an average density of fluids produced by the hydrocarbon well and facilitates production of reservoir fluids from the hydrocarbon well.

The mechanically actuated gas lift valves generally are installed during well completion and essentially act as pressure regulators that selectively inject the high-pressure gas stream when a pressure differential across the mechanically actuated gas lift valve exceeds a threshold pressure differential. It typically is desirable to inject the high-pressure gas stream via the most downhole mechanically actuated gas lift valve that experiences a pressure differential that is within a predetermined pressure differential range. In order to facilitate such selective injection, each mechanically actuated gas lift valve generally is configured to open at a slightly different pressure differential when compared to the other mechanically actuated gas lift valves. Typically, these pressure differentials are established or preconfigured, when the valves are installed.

The lift gas supply system that provides the high-pressure gas stream must be designed to accommodate not only the needed injection pressure but also the pressure overhead that is due to purposeful valve-to-valve pressure differential differences, thereby decreasing system efficiency. In addition, the mechanically actuated gas lift valves may, in certain circumstances, repeatedly cycle and/or chatter, thereby increasing wear and/or decreasing an operational life span of the gas lift system. Furthermore, drift and/or changes in the pressure differential that opens a given mechanically actuated gas lift valve may lead to inefficiency and/or an inability to accurately predict which mechanically actuated gas lift valve is providing the high-pressure gas stream at a given point in time, further decreasing system efficiency. Thus, there exists a need for hydrocarbon wells including electrically actuated gas lift valve assemblies and/or for methods of providing gas lift in the hydrocarbon wells.

SUMMARY OF THE DISCLOSURE

Hydrocarbon wells including electrically actuated gas lift valve assemblies and methods of providing gas lift in a hydrocarbon well. The hydrocarbon wells include a wellbore that extends within a subterranean formation and downhole tubing that extends within the wellbore and defines a tubing conduit. The downhole tubing and the wellbore define an annular space therebetween. One of the tubing conduit and the annular space defines a production conduit for the hydrocarbon well, and the other of the tubing conduit and the annular space defines a lift gas supply conduit for the hydrocarbon well. The hydrocarbon wells also include a lift gas supply system configured to provide a lift gas stream to the lift gas supply conduit, a plurality of electrically actuated gas lift valve assemblies, a valve power supply system, and a controller.

The plurality of electrically actuated gas lift valve assemblies is spaced apart along a length of the downhole tubing, and each electrically actuated gas lift valve assembly includes a gas injection conduit, a valve assembly orifice, and an electrically actuated shut-off valve. The gas injection conduit extends between the production conduit and the lift gas supply conduit. The valve assembly orifice defines an orifice portion of the gas injection conduit. The electrically actuated shut-off valve defines a valve portion of the gas injection conduit and is configured to be selectively transitioned between an open state and a closed state. In the open state, the electrically actuated shut-off valve permits fluid flow through the gas injection conduit. In the closed state, the electrically actuated shut-off valve restricts fluid flow through the gas injection conduit.

The valve power supply system is configured to supply an electric current to electrically power the plurality of electrically actuated gas lift valve assemblies. The controller is programmed to selectively provide a respective control signal to each electrically actuated gas lift valve assembly to control the operation of the plurality of electrically actuated gas lift valve assemblies.

The methods include providing a lift gas stream to a lift gas supply conduit and measuring a respective pressure differential between the lift gas supply conduit and a production conduit at each electrically actuated gas lift valve assembly in a plurality of electrically actuated gas lift valve assemblies. The methods also include selectively opening a selected electrically actuated gas lift valve assembly based on the respective pressure differential measured at the selected electrically actuated gas lift valve assembly. The methods further include providing the lift gas stream to the production conduit via the selected electrically actuated gas lift valve assembly.

DETAILED DESCRIPTION AND BEST MODE OF THE DISCLOSURE

Figure 1:
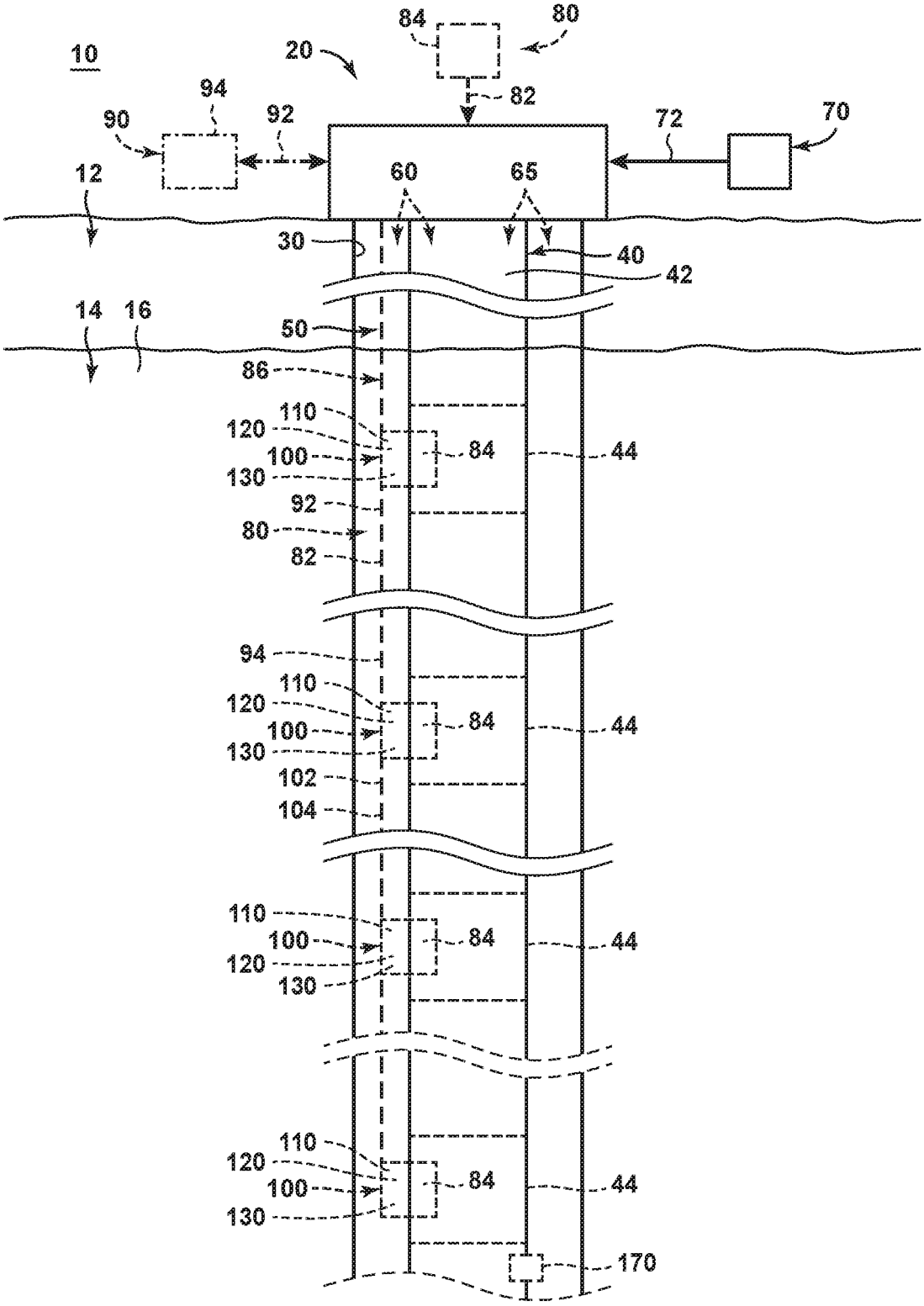
FIG. 1 is a schematic illustration of examples of a hydrocarbon well that may include electrically actuated gas lift valve assemblies, according to the present disclosure.

FIGS. 1-5 provide examples of hydrocarbon wells 20, of electrically actuated gas lift valve assemblies 100, and/or of methods 200, according to the present disclosure. Elements that serve a similar, or at least substantially similar, purpose are labeled with like numbers in each of FIGS. 1-5, and these elements may not be discussed in detail herein with reference to each of FIGS. 1-5. Similarly, all elements may not be labeled in each of FIGS. 1-5, but reference numerals associated therewith may be utilized herein for consistency. Elements, components, and/or features that are discussed herein with reference to one or more of FIGS. 1-5 may be included in and/or utilized with any of FIGS. 1-5 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of examples of a hydrocarbon well 20 that may include electrically actuated gas lift valve assemblies 100, according to the present disclosure. As illustrated in solid lines in FIG. 1, hydrocarbon wells 20 include a wellbore 30 that extends within a subterranean formation 14. Wellbore 30 also may be referred to herein as extending between a surface region 10 and the subterranean formation and/or as extending within a subsurface region 12. Subterranean formation 14 may include reservoir fluid 16.

Downhole tubing 40 extends within wellbore 30 and defines a tubing conduit 42. Wellbore 30 and downhole tubing 40 together define, or at least partially define, an annular space 50 therebetween. As discussed in more detail herein, one of annular space 50 and tubing conduit 42 may be referred to herein as a production conduit 60 of the hydrocarbon well, while the other of annular space 50 and tubing conduit 42 may be referred to herein as a lift gas supply conduit 65 of the hydrocarbon well. Production conduit 60 may be configured to produce reservoir fluid 16 from the subterranean formation. Hydrocarbon well 20 also includes a lift gas supply system 70. The lift gas supply system is configured to provide a lift gas stream 72 to lift gas supply conduit 65.

Hydrocarbon well 20 further includes a plurality of electrically actuated gas lift valve assemblies 100, a valve power supply system 80, and a controller 90. Valve power supply system 80 is configured to supply an electric current 82 to electrically power electrically actuated gas lift valve assemblies 100. Controller 90 is programmed to selectively provide a respective control signal 92 to each electrically actuated gas lift valve assembly to control the operation of the plurality of electrically actuated gas lift valve assemblies.

Electrically actuated gas lift valve assemblies 100 are spaced apart along a length of downhole tubing 40. As discussed in more detail herein with reference to FIGS. 2-4, each electrically actuated gas lift valve assembly includes a gas injection conduit 110, a valve assembly orifice 120, and an electrically actuated shut-off valve 130. The gas injection conduit extends between production conduit 60 and lift gas supply conduit 65. The valve assembly orifice defines an orifice portion of the gas injection conduit. As used herein, the term "orifice" may refer to any suitable structure and/or region that defines a cross-sectional area for fluid flow therethrough. With this in mind, valve assembly orifice 120 and/or the orifice portion of the gas injection conduit may have and/or define any suitable shape, examples of which include cylindrical, at least partially cylindrical, circular, at least partially circular, venturi-shaped, tapered, conic, at least partially conic, conic shell-shaped, and/or at least partially conic shell-shaped. It is within the scope of the present disclosure that the leading and/or trailing edges of valve assembly orifice 120 and/or of the orifice portion of the gas injection conduit may be angular, may define a right angle, may be arcuate, and/or may be curved.

The electrically actuated shut-off valve defines a valve portion of the gas injection conduit and is configured to be selectively and electrically transitioned between an open state and a closed state. When in the open state, the electrically actuated shut-off valve permits fluid flow through gas injection conduit 110 and/or through the valve portion thereof. In contrast, when in the closed state, the electrically actuated shut-off valve restricts, blocks, and/or occludes fluid flow through the gas injection conduit and/or though the valve portion thereof During operation of hydrocarbon well 20, and as discussed in more detail herein with reference to methods 200 of FIG. 5, lift gas supply system 70 may provide lift gas stream 72 to lift gas supply conduit 65. The lift gas stream may pressurize the lift gas supply conduit, thereby generating, or increasing, a pressure differential between the lift gas supply conduit and production conduit 60. The pressure differential may vary along the length of wellbore 30 with depth due to hydrostatic pressure effects. As such, the pressure differential across each electrically actuated gas lift valve assembly 100 may differ from the pressure differential across each other electrically actuated gas lift valve assembly 100.

Controller 90 may control the operation of electrically actuated gas lift valve assemblies 100. This may include opening and/or closing selected electrically actuated gas lift valve assemblies such that lift gas stream 72 is injected into production conduit 60 at a desired location, or within a desired region, along the length of the wellbore. As an example, and as discussed in more detail herein, controller 90 and/or sensors that are in communication with the controller may measure, monitor, and/or determine the pressure differential across at least a subset, or even all, of the plurality of electrically actuated gas lift valve assemblies 100. Under these conditions, controller 90 may utilize control signal 92 to command a selected electrically actuated gas lift valve assembly 100 to transition to a corresponding open state while maintaining the other electrically actuated gas lift valve assemblies in respective closed states. This may cause lift gas stream 72 to be injected into the production conduit via a selected gas injection conduit 110 of the selected electrically actuated gas lift valve assembly.

As discussed, one of tubing conduit 42 and annular space 50 is, or functions as, production conduit 60 while the other of tubing conduit 42 and annular space 50 is, or functions as, lift gas supply conduit 65. As an example, production conduit 60 may be defined by tubing conduit 42, and lift gas supply conduit 65 may be defined by annular space 50. As another example, production conduit 60 may be defined by annular space 50, and lift gas supply conduit 65 may be defined by tubing conduit 42. As yet another example, hydrocarbon well 20 may be configured such that the production conduit is selectively varied between the tubing conduit and the annular space. Under these conditions, the lift gas supply conduit will selectively vary between the tubing conduit and the annular space in a corresponding manner. Stated another way, at any given point in time, the production conduit is defined by one of the tubing conduit and the annular space, while the lift gas supply conduit is defined by the other of the tubing conduit and the annular space.

Hydrocarbon wells 20 that include electrically actuated gas lift valve assemblies 100, according to the present disclosure, may provide benefits over conventional and/or mechanically actuated gas lift valves. As an example, electrically actuated gas lift valve assemblies 100 may eliminate the need for a different pressure differential to trigger the opening of each gas lift valve, as is common for mechanically actuated gas lift valves. As such, the pressure overhead associated with these different pressure differentials may be eliminated. As another example, in hydrocarbon wells 20 according to the present disclosure, the precise location where the lift gas stream is injected into the production conduit may be known, determined, and/or selectively controlled in real-time. As yet another example, control of lift gas supply, via electrically actuated gas lift valve assemblies 100, may be automated within a single hydrocarbon well and/or among a plurality of hydrocarbon wells that may be associated with a given subterranean formation.

As another example, electrically actuated gas lift valve assemblies 100 may provide an improved, or increased, operational life by decreasing and/or eliminating valve chatter that may be caused by pressure fluctuations in hydrocarbon wells that utilize mechanically actuated gas lift valves. As yet another example, and as discussed, the specific fluid conduit (e.g., tubing conduit 42 and/or annular space 50) that defines the production conduit and/or the lift gas supply conduit may be selectively varied and/or reversed. As another example, and as discussed in more detail herein, sensors associated with each electrically actuated gas lift valve assembly 100 may provide real-time information regarding the pressure differential across the electrically actuated gas lift valve assemblies.

Valve power supply system 80 may include any suitable structure that may be adapted, configured, designed, and/or constructed to supply electric current 82 to electrically power electrically actuated gas lift valve assemblies 100. In addition, valve power supply system 80 may be positioned at any suitable location within hydrocarbon well 20, examples of which include within surface region 10, within subsurface region 12, and/or within electrically actuated gas lift valve assemblies 100.

Valve power supply system 80 may include a power source 84 that may be configured to produce, to generate, and/or to provide electric current 82, such as to the plurality of electrically actuated gas lift valve assemblies. Examples of valve power supply system 80 and/or of power source 84 thereof include a generator, a battery, a downhole battery, an energy harvesting structure, a downhole energy harvesting structure, and/or a main power source. Electric current 82 may include any suitable alternating current (AC) electric current and/or direct current (DC) electric current. With this in mind, power source 84 may include an alternating current power source and/or a direct current power source.

It is within the scope of the present disclosure that valve power supply system 80 may be electrically coupled to, or in electrical communication with, electrically actuated gas lift valve assemblies 100 in any suitable manner and/or utilizing any suitable structure. As an example, valve power supply system 80 may be at least partially integrated into electrically actuated gas lift valve assemblies 100. As another example, valve power supply system 80 may be directly coupled, such as via a direct electrical coupling, to electrically actuated gas lift valve assemblies 100. As yet another example, valve power supply system 80 may be indirectly coupled, such as via an inductive electrical coupling, to electrically actuated gas lift valve assemblies 100.

When valve power supply system 80 and/or power source 84 thereof is positioned within surface region 10, is distal from electrically actuated gas lift valve assemblies 100, and/or is not integral with electrically actuated gas lift valve assemblies 100, the valve power supply system may include an electrical cable 86. Electrical cable 86 may include and/or be a tubing encapsulated conductor. Electrical cable 86 may extend among the plurality of electrically actuated gas lift valve assemblies 100 and/or may extend between power source 84 and the plurality of electrically actuated gas lift valve assemblies 100. As illustrated in FIG. 1, electrical cable 86 may extend from surface region 10, such as when power source 84 is positioned within the surface region. Under these conditions, controller 90 also may be positioned within the surface region and/or may be configured to provide the respective control signal to each electrically actuated gas lift valve assembly via the electrical cable.

It is within the scope of the present disclosure that electrical cable 86 may include and/or be a single electrical conductor. The single electrical conductor may be configured to supply the electric current to each electrically actuated gas lift valve and/or to provide the respective control signal to each electrically actuated gas lift valve assembly. Stated another way, electrical cable 86 may not include a separate, a distinct, and/or a dedicated electrical conductor for each electrically actuated gas lift valve assembly. Instead, the plurality of electrically actuated gas lift valve assemblies may share, or utilize, the single electrical conductor both to receive electric current 82 from valve power supply system 80 and also to communicate with controller 90.

As an example, electrical actuated gas lift valve assemblies 100 may receive control signal 92 from controller 90 via the single electrical conductor. As another example, each electrically actuated gas lift valve assembly may provide at least one state signal 102 to the controller via the single electrical conductor. As yet another example, each electrically actuated gas lift valve assembly may provide at least one sensor signal 104 to the controller via the single electrical conductor. Examples of the state signal, the control signal, and/or the sensor signal are disclosed herein.

To facilitate powering and/or control of each electrically actuated gas lift valve assembly 100 via the single electrical conductor of electrical cable 86, hydrocarbon well 20 may be configured such that electrically actuated gas lift valve assemblies 100 simultaneously, continuously, and/or at least substantially continuously receive electric current 82. Additionally or alternatively, hydrocarbon well 20 may be configured such that each electrically actuated gas lift valve assembly 100 receives the respective control signal of each other electrically actuated gas lift valve assembly 100. Under these conditions, the respective control signal may include a respective unique identifier that causes a respective electrically actuated gas lift valve assembly to respond to the respective control signal. Stated another way, a given electrically actuated gas lift valve assembly 100 may respond to the respective control signal and/or may utilize the electric current only if the respective unique identifier indicates that the respective control signal is addressed to, or is intended for, the given electrically actuated gas lift valve assembly.

Controller 90 may include any suitable structure that may be adapted, configured, designed, constructed, and/or programmed to selectively provide respective control signal 92 to each electrically actuated gas lift valve assembly to control the operation of the plurality of electrically actuated gas lift valve assemblies. Stated another way, controller 90 may include and/or be any suitable structure, device, and/or devices that may be adapted, configured, designed, constructed, and/or programmed to perform the functions discussed herein. As examples, controller 90 may include one or more of an electronic controller, a dedicated controller, a special-purpose controller, a personal computer, a special-purpose computer, a display device, a logic device, a memory device, and/or a memory device having computer-readable storage media.

The computer-readable storage media, when present, also may be referred to herein as non-transitory computer readable storage media. This non-transitory computer readable storage media may include, define, house, and/or store computer-executable instructions, programs, and/or code; and these computer-executable instructions may instruct hydrocarbon well 20 and/or controller 90 thereof to perform any suitable portion, or subset, of methods 200, which are discussed in more detail herein. Examples of such non-transitory computer-readable storage media include CD-ROMs, disks, hard drives, flash memory, etc. As used herein, storage, or memory, devices and/or media having computer-executable instructions, as well as computer-implemented methods and other methods according to the present disclosure, are considered to be within the scope of subject matter deemed patentable in accordance with Section 101 of Title 35 of the United States Code.

It is within the scope of the present disclosure that controller 90 may communicate with electrically actuated gas lift valve assemblies 100 in any suitable manner. As an example, hydrocarbon well 20 may include a communication linkage 94 that may be configured to convey the respective control signal to each electrically actuated gas lift valve assembly. Communication linkage 94 may include and/or be a wired communication linkage and/or a wireless communication linkage. An example of a wired communication linkage includes electrical cable 86, as discussed herein. Stated another way, communication linkage 94 may be at least partially defined by valve power supply system 80 and/or be electrical cable 86 thereof.

It is within the scope of the present disclosure that controller 90 may include and/or be a single controller that is in communication with the plurality of electrically actuated gas lift valve assemblies via the communication linkage. Such a single controller may be positioned within surface region 10, as illustrated in FIG. 1. It is also within the scope of the present disclosure that controller 90 may include a plurality of controllers, or a plurality of discrete controllers. Under these conditions, each controller in the plurality of controllers may be configured to provide the respective control signal to a selected electrically actuated gas lift valve assembly and/or to a selected subset of the plurality of electrically actuated gas lift valve assemblies.

Lift gas supply system 70 may include any suitable structure that may be adapted, configured, designed, and/or constructed to provide lift gas stream 72 to lift gas supply conduit 65. As examples, lift gas supply system 70 may include one or more fluid conduits, pipes, tubes, valves, compressors, lift gas storage tanks, lift gas generators, and/or the like. Examples of the lift gas stream include an air stream, a natural gas stream, a carbon dioxide stream, and/or a nitrogen stream.

As illustrated in dashed lines in FIG. 1, hydrocarbon well 20 may include a high-pressure bypass assembly 170. High-pressure bypass assembly 170, when present, may be configured to equalize pressure between production conduit 60 and lift gas supply conduit 65 responsive to the pressure differential between the production conduit and the lift gas supply conduit exceeding a threshold maximum pressure differential. Stated another way, high-pressure bypass assembly 170 may be configured to restrict the pressure differential to less than the threshold minimum pressure differential, which may decrease a potential for overpressurization of hydrocarbon well 20 via supply of lift gas stream 72. High-pressure bypass assembly 170, when present, may be positioned downhole from the plurality of electrically actuated gas lift valve assemblies and/or downhole from every electrically actuated gas lift valve assembly in the plurality of electrically actuated gas lift valve assemblies. Examples of the high-pressure bypass assembly include a burst disc assembly and/or a conventional, mechanically actuated, gas lift valve.

It is within the scope of the present disclosure that electrically actuated gas lift valve assemblies 100 may be included and/or incorporated into hydrocarbon well 20 in any suitable manner. As an example, hydrocarbon well 20 may include a plurality of mandrels 44, which may form a portion of downhole tubing 40, may at least partially define tubing conduit 42, and/or may operatively interconnect various tubing segments of the downhole tubing. Under these conditions, each electrically actuated gas lift valve assembly 100 may be operatively attached to, may be integrated into, and/or may form a portion of a corresponding mandrel 44. Examples of mandrels 44 included conventional mandrels and/or side pocket mandrels.

Figure 2:
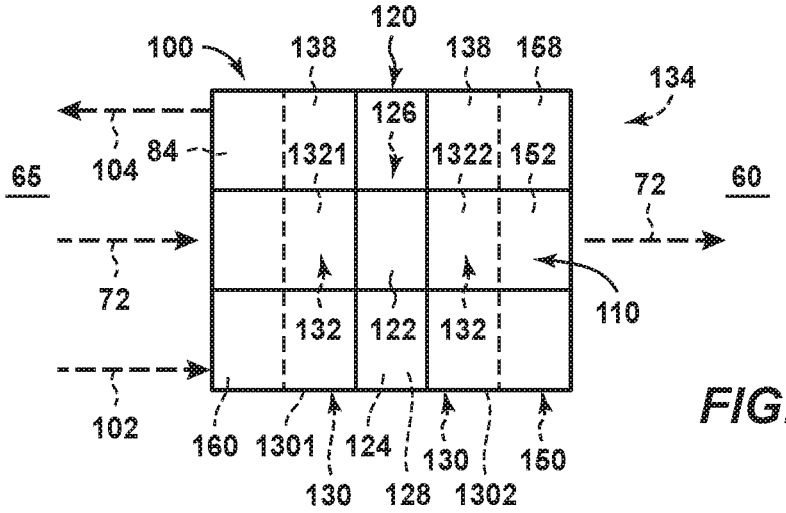
FIG. 2 is a schematic illustration of examples of electrically actuated gas lift valve assemblies according to the present disclosure.
Figure 3:
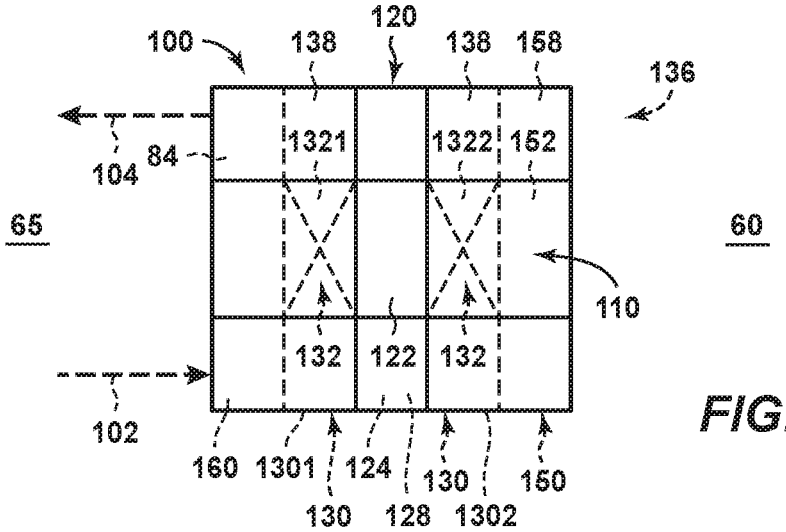
FIG. 3 is another schematic illustration of examples of electrically actuated gas lift valve assemblies according to the present disclosure.
Figure 4:
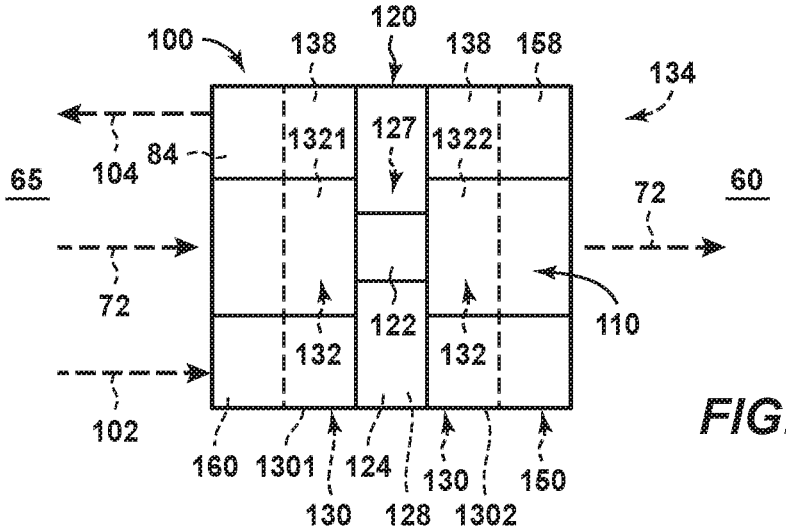
FIG. 4 is another schematic illustration of examples of electrically actuated gas lift valve assemblies according to the present disclosure.

FIGS. 2-4 are schematic illustrations of examples of electrically actuated gas lift valve assemblies 100 according to the present disclosure. As discussed herein with reference to FIG. 1, electrically actuated gas lift valve assemblies 100 include gas injection conduit 110, valve assembly orifice 120, and electrically actuated shut-off valve 130. As also discussed, valve assembly orifice 120 defines an orifice portion 122 of gas injection conduit 110. In addition, electrically actuated shut-off valve 130 defines a valve portion 132 of gas injection conduit 110 and is configured to be selectively and electrically transitioned between open state 134, as illustrated in FIGS. 2 and 4, and closed state 136, as illustrated in FIG. 3.

Electrically actuated shut-off valves 130 may include any suitable structure that may transition between open state 134 and closed state 136. Examples of electrically actuated shut-off valves 130 include a solenoid valve, a motorized valve, a rotary valve, and/or a linear valve.

It is within the scope of the present disclosure that electrically actuated shut-off valves 130 may include and/or be a binary valve that may be configured to define only open state 134 and closed state 136. Stated another way, electrically actuated shut-off valves 130 may define only two states, the open state and the closed state, and/or may not define one or more intermediate states between the open state and the closed state. With this in mind, the respective control signal may include a shut-off valve state signal that specifies a selected valve state (e.g., the open state or the closed state) for the electrically actuated shut-off valve. Under these conditions, and responsive to receipt of the shut-off valve state signal, the electrically actuated shut-off valve may be configured to transition to the selected valve state.

It is also within the scope of the present disclosure that electrically actuated shut-off valve 130 that is associated with a given electrically actuated gas lift valve assembly 100 may be configured to transition between the corresponding open state and the corresponding closed state responsive to receipt of the respective control signal. In addition, the electrically actuated shut-off valve may be configured to remain in a given state, subsequent to receipt of the respective control signal, until the electrically actuated shut-off valve receives a subsequent respective control signal that commands the electrically actuated shut-off valve to change states. Stated another way, electrically actuated shut-off valves 130 may be bi-stable valves configured to remain in the most recently selected state (i.e., the open state or the closed state) until commanded to transition out of the most recently selected state. Such a configuration may permit hydrocarbon wells 20 to operate during intermittent power failures, may permit hydrocarbon wells 20 to operate with only periodic supply of electric current 82 to electrically actuated gas lift valve assemblies 100, and/or may permit electrically actuated gas lift valve assemblies 100 to conserve electrical power by only drawing electric current 82 when transitioning between the open state and the closed state.

It is within the scope of the present disclosure that electrically actuated shut-off valves 130 may have any suitable orientation, within electrically actuated gas lift valve assemblies 100, relative to other components of the electrically actuated gas lift valve assemblies. As an example, valve portion 132 may be positioned, along gas injection conduit 110, between lift gas supply conduit 65 and orifice portion 122. As another example, valve portion 132 may be positioned, along gas injection conduit 110, between production conduit 60 and orifice portion 122.

It is also within the scope of the present disclosure that electrically actuated gas lift valve assemblies 100 may include a plurality of electrically actuated shut-off valves 130, including at least a first electrically actuated shut-off valve 1301 that defines a first valve portion 1321 of gas injection conduit 110 and a second electrically actuated shut-off valve 1302 that defines a second valve portion 1322 of the gas injection conduit. Under these conditions, orifice portion 122 may be positioned between first valve portion 1321 and second valve portion 1322.

Electrically actuated shut-off valves 130 may include a shut-off valve-state sensor 138. Shut-off valve-state sensor 138, when present, may be configured to detect a valve state (e.g., the open state or the closed state) of the electrically actuated shut-off valve and to provide a corresponding state signal 102, which also may be referred to herein as a shut-off valve-state signal and is indicative to the valve state, to controller 90.

As illustrated in dashed lines in FIGS. 2-4, electrically actuated gas lift valve assemblies 100 may include a check valve 150. Check valve 150, when present, may define a check valve portion 152 of gas injection conduit 110. Check valve 150 may be configured to permit fluid flow, via gas injection conduit 110, from lift gas supply conduit 65 to production conduit 60 and also to restrict, to block, and/or to occlude fluid flow from the production conduit to the lift gas supply conduit.

Check valve 150 may include any suitable structure. As an example, check valve 150 may include and/or be a mechanical, or a mechanically operated, check valve. As additional examples, check valve 150 may include and/or be a ball check valve, a diaphragm check valve, a swing check valve, and/or a tilting disc check valve.

Check valve 150, when present, may be positioned with any suitable orientation relative to other components of electrically actuated gas lift valve assemblies 100. As an example, check valve portion 152 of gas injection conduit 110 may be positioned, along the gas injection conduit, between valve portion 132 of the gas injection conduit and production conduit 60. Such a configuration may protect valve portion 132 from corrosive materials and/or debris that may be present within the production conduit.

Check valves 150 may include a check valve-state sensor 158 configured to detect a state (e.g., open or closed) of the check valve. The check valve-state sensor, when present, may generate a corresponding state signal 102, which also may be referred to herein as a check valve-state signal, that is indicative of the state of the check valve and/or may provide the check valve-state signal to controller 90.

Valve assembly orifice 120 may include any suitable structure that may define orifice portion 122 of lift gas supply conduit 65. In general, orifice portion 122 may be a region of restricted and/or predetermined cross-sectional area of gas injection conduit 110 such that orifice portion 122 regulates and or specifies a flow rate of lift gas stream 72 through the gas injection conduit. Stated another way, valve assembly orifice 120 and/or orifice portion 122 thereof may be sized to provide a desired lift gas stream flow rate through the gas injection conduit.

It is within the scope of the present disclosure that valve assembly orifice 120 may be a fixed-size valve assembly orifice. Stated another way, orifice portion 122 may have and/or define a fixed cross-sectional area for fluid flow therethrough.

However, this is not required of all embodiments, and it is also within the scope of the present disclosure that valve assembly orifice 120 may be an adjustable valve assembly orifice 124. Such an adjustable valve assembly orifice 124 may be configured to be selectively and electrically transitioned among a plurality of orifice sizes between a minimum orifice size, as schematically illustrated in FIG. 4 at 127, and a maximum orifice size, as schematically illustrated in FIG. 2 at 126. Under these conditions, the respective control signal may include an orifice size signal that specifies a selected size for the adjustable valve assembly orifice, and responsive to receipt of the orifice size signal, adjustable valve assembly orifice 124 may be configured to transition to the selected orifice size. Examples of the electrically actuated gas lift valve include a globe valve, a pinch valve, a diaphragm valve, and/or a needle valve.

It is within the scope of the present disclosure that the plurality of orifice sizes may include a plurality of discrete orifice sizes, examples of which includes at least 3, at least 4, at least 5, at least 6, at least 8, and/or at least 10 orifice sizes. Alternatively, it is also within the scope of the present disclosure that the plurality of orifice sizes may include a continuous range of orifice sizes that extends between the minimum orifice size and the maximum orifice size.

The minimum orifice size may be non-zero. Stated another way, orifice portion 122 may define a finite cross-sectional area for fluid flow therethrough when at the minimum orifice size. Examples of the minimum orifice size include minimum orifice sizes of at least 2 square millimeters, at least 3 square millimeters, at least 4 square millimeters, at least 6 square millimeters, at least 8 square millimeters, at least 10 square millimeters, at least 15 square millimeters, at least 20 square millimeters, at least 30 square millimeters, at least 40 square millimeters, and/or at least 50 square millimeters. Examples of the maximum orifice size include maximum orifice sizes of at most 200 square millimeters, at most 175 square millimeters, at most 150 square millimeters, at most 125 square millimeters, at most 100 square millimeters, at most 75 square millimeters, and/or at most 50 square millimeters.

It is within the scope of the present disclosure that electrically actuated gas lift valve assemblies 100 may include an orifice size sensor 128. Orifice size sensor 128 when present, may be configured to detect an orifice size of adjustable valve assembly orifice 124 and to provide a corresponding state signal 102, which also may be referred to herein as an orifice size signal, to controller 90.

It is within the scope of the present disclosure that electrically actuated gas lift valve assemblies 100 may include one or more additional sensors 160. Additional sensors 160, when present, may be configured to detect one or more additional parameters within a region of the wellbore that is proximal the electrically actuated gas lift valve assemblies and/or to provide a corresponding sensor signal 104 to controller 90. As an example, electrically actuated gas lift valve assemblies 100 may include a differential pressure sensor configured to detect a differential pressure between lift gas supply conduit 65 and production conduit 60. Under these conditions, the differential pressure sensor may be configured to generate corresponding sensor signal 104, in the form of a pressure differential sensor signal, that is indicative of the pressure differential. The differential pressure sensor also may be configured to provide the pressure differential sensor signal to controller 90.

The pressure differential may include any suitable pressure differential. As an example, the differential pressure sensor may detect the pressure differential within a region of the hydrocarbon well that includes the gas injection conduit. As another example, the differential pressure sensor may be configured to detect the pressure differential across the gas injection conduit.

When electrically actuated gas lift valve assemblies 100 include the differential pressure sensor, controller 90 may be programmed to selectively transition the electrically actuated shut-off valve of each electrically actuated gas lift valve assembly between a corresponding open state and a corresponding closed state based, at least in part, on the pressure differential and/or on the differential pressure signal. Stated another way, controller 90 may be programmed to independently transition the electrically actuated shut-off valve of each electrically actuated gas lift valve assembly between the corresponding open state and the corresponding closed state based, at least in part, on a corresponding pressure differential that is associated with, or measured by, the electrically actuated gas lift valve assembly. This may include transitioning a selected electrically actuated shut-off valve of a selected electrically actuated gas lift valve assembly from a corresponding closed state to a corresponding open state responsive to a respective pressure differential, as measured by the selected electrically actuated gas lift valve assembly, exceeding a threshold pressure differential. Examples of the threshold pressure differential include threshold pressure differentials of 0.25 Megapascals (MPa), 0.5 MPa, 0.75 MPa, 1 MPa, 1.25 MPa, and/or 1.5 MPa.

As another example, electrically actuated gas lift valve assemblies 100 may include a pressure sensor configured to detect a pressure within a region of the hydrocarbon well that includes the gas injection conduit. Under these conditions, the pressure sensor may be configured to generate corresponding sensor signal 104, in the form of a pressure differential sensor signal, that is indicative of the pressure differential. The differential pressure sensor also may be configured to provide the pressure differential sensor signal to controller 90.

Controller 90 additionally or alternatively may be programmed to calculate an injection rate of lift gas stream 72 into production conduit 60 via gas injection conduit 110. This calculation of the injection rate may be based, at least in part, on the pressure differential and/or on a cross-sectional area of orifice portion 122. Additionally or alternatively, and when electrically actuated gas lift valve assemblies 100 include adjustable valve assembly orifice 124, controller 90 may be programmed to adjust the injection rate, such as by adjusting the size of orifice portion 122. This may include adjusting the injection rate to maintain the injection rate within a target injection rate range and/or adjusting the injection rate to maintain a gas-to-liquid ratio within the production conduit within a target gas-to-liquid ratio range.

In addition, or as an alternative, to the differential pressure sensor, sensors 160 may include and/or be a pressure sensor, a differential temperature sensor, a temperature sensor, a flow sensor, and/or an acoustic sensor. The pressure sensor, when present, may be configured to detect a pressure in the production conduit, in the lift gas supply conduit, and/or within the gas injection conduit. The pressure sensor additionally may be configured to generate a corresponding sensor signal 104, in the form of a pressure sensor signal that is indicative of the pressure, and to provide the pressure sensor signal to controller 90.

The temperature differential sensor, when present, may be configured to detect a temperature differential between the production conduit and the lift gas supply conduit. The temperature differential sensor additionally may be configured to generate a corresponding sensor signal 104, in the form of a temperature differential sensor signal that is indicative of the temperature differential, and to provide the temperature differential sensor signal to controller 90.

The temperature sensor, when present, may be configured to detect a temperature within the production conduit, within the lift gas supply conduit, and/or within the gas injection conduit. The temperature sensor additionally may be configured to generate a corresponding sensor signal 104, in the form of a temperature sensor signal that is indicative of the temperature, and to provide the temperature sensor signal to controller 90.

The flow sensor, when present, may be configured to detect a flow rate of the lift gas stream through the gas injection conduit. The flow sensor additionally may be configured to generate a corresponding sensor signal 104, in the form of a flow sensor signal that is indicative of the flow rate, and to provide the flow sensor signal to controller 90.

The acoustic sensor, when present, may be configured to detect a vibration proximal the electrically actuated gas lift valve assembly. The acoustic sensor additionally may be configured to generate a corresponding sensor signal 104, in the form of an acoustic sensor signal that is indicative of the vibration, and to provide the acoustic sensor signal to controller 90.

Figure 5:
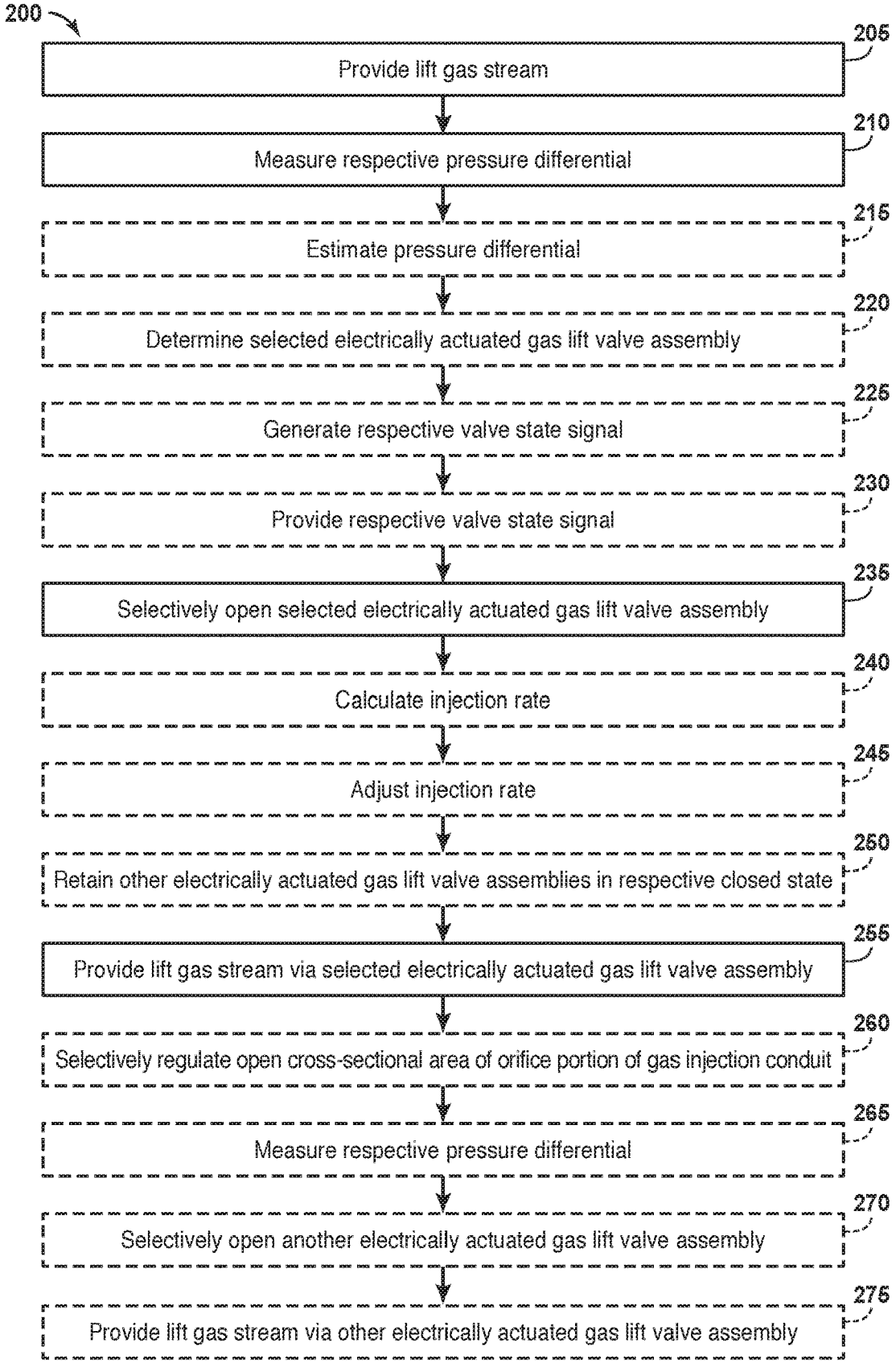
FIG. 5 is a flowchart depicting examples of methods of providing gas lift in a hydrocarbon well, according to the present disclosure.

FIG. 5 is a flowchart depicting examples of methods 200 of providing gas lift in a hydrocarbon well, according to the present disclosure. The hydrocarbon well may include and/or be hydrocarbon well 20 of FIG. 2 and may include a plurality of electrically actuated gas lift valve assemblies, examples of which include electrically actuated gas lift valve assemblies 100 of FIGS. 1-4.

Methods 200 include providing a lift gas stream at 205 and measuring a respective pressure differential at 210. Methods 200 may include estimating a pressure differential at 215, determining a selected electrically actuated gas lift valve assembly at 220, generating a respective valve state signal at 225, and/or providing the respective valve state signal at 230 and include selectively opening the selected electrically actuated gas lift valve assembly at 235. Methods 200 also may include calculating an injection rate at 240, adjusting the injection rate at 245, and/or retaining other electrically actuated gas lift valve assemblies in a respective closed state at 250 and includes providing a lift gas stream via the selected electrically actuated gas lift valve assembly at 255. Methods 200 further may include selectively regulating an open cross-sectional area of an orifice portion of a gas injection conduit at 260, measuring a respective pressure differential at 265, selectively opening another electrically actuated gas lift valve assembly at 270, and/or providing the gas lift stream via the other electrically actuated gas lift valve assembly at 275.

Providing the lift gas stream at 205 may include providing the lift gas stream to a lift gas supply conduit of the hydrocarbon well. The lift gas stream may be provided in any suitable manner. As an example, the lift gas stream may be provided with, via, and/or utilizing a lift gas supply system, such as lift gas supply system 70 of FIG. 1. Examples of the lift gas supply conduit are disclosed herein with reference to lift gas supply conduit 65 of FIGS. 1-4. Examples of the lift gas stream are disclosed herein with reference to lift gas stream 72 of FIGS. 2-4.

Measuring the respective pressure differential at 210 may include measuring the respective pressure differential between the lift gas supply conduit and the production conduit. This may include measuring the respective pressure differential at, near, proximal, and/or with each electrically actuated gas lift valve assembly. Stated another way, the measuring at 210 may include measuring a plurality of respective pressure differentials, with each respective pressure differential in the plurality of respective pressure differentials being associated with a corresponding electrically actuated gas lift valve assembly in the plurality of electrically actuated gas lift valve assemblies.

The measuring at 210 may be accomplished in any suitable manner. As examples, the measuring at 210 may include measuring with, via, and/or utilizing each electrically actuated gas lift valve assembly and/or with, via, and/or utilizing a differential pressure sensor of, or associated with, each electrically actuated gas lift valve assembly. The measuring at 210 additionally or alternatively may include providing a respective differential pressure signal, which is indicative of the respective pressure differential at a given electrically actuated gas lift valve assembly, from each electrically actuated gas lift valve assembly to a controller of the hydrocarbon well. Examples of the differential pressure sensor and the differential pressure signal are disclosed herein with reference to sensor 160 of FIGS. 2-4. Examples of the controller are disclosed herein with reference to controller 90 of FIG. 1.

It is within the scope of the present disclosure that the hydrocarbon well may include a damaged electrically actuated gas lift valve assembly. The damaged electrically actuated gas lift valve assembly may not include the differential pressure sensor and/or the differential pressure sensor of the damaged electrically actuated gas lift valve assembly may be damaged and/or may be unable to generate a corresponding differential pressure signal. As such, a respective pressure differential between the lift gas supply conduit and the production conduit, at the damaged electrically actuated gas lift valve assembly, may be unavailable. Under these conditions, methods 200 may include the estimating the pressure differential at 215. The estimating at 215 may include estimating the respective pressure differential between the lift gas supply conduit and the production conduit at, near, and/or proximal the damaged electrically actuated gas lift valve assembly. The estimating at 215 may be based, at least in part, on the respective pressure differential between the lift gas supply conduit and the production conduit as measured at each electrically actuated gas lift valve assembly in the plurality of electrically actuated gas lift valve assemblies. Stated another way, the estimating at 215 may include estimating an unknown, or an unmeasured, pressure differential based, at least in part, on known and/or measured pressure differentials and/or based, at least in part, on a relative location of the plurality of electrically actuated gas lift valve assemblies and the damaged electrically actuated gas lift valve assembly. As an example, the estimating at 215 may include interpolating, or linearly interpolating, among two or more respective pressure differentials, which were measured during the measuring at 210, to estimate the pressure differential at the damaged electrically actuated gas lift valve assembly.

Determining the selected electrically actuated gas lift valve assembly at 220 may include determining, or selecting, the selected electrically actuated gas lift valve assembly in any suitable manner. As an example, the determining at 220 may include determining based, at least in part, on the respective pressure differential received, by the controller and during the measuring at 210, from each electrically actuated gas lift valve assembly.

Generating the respective valve state signal at 225 may include generating, with the controller, any suitable signal that directs, or commands, the selected electrically actuated gas lift valve assembly to transition to, to assume, to take on, and/or to remain in an open state. The respective valve state signal may be such that, upon receipt of the respective valve state signal, the selected electrically actuated gas lift valve assembly transitions to, or remains within, the open state.

Providing the respective valve state signal at 230 may include providing the respective valve state signal from the controller and/or to the selected electrically actuated gas lift valve assembly. This may include providing with, via, and/or utilizing any suitable communication linkage, such as communication linkage 94 of FIG. 1.

Selectively opening the selected electrically actuated gas lift valve assembly at 235 may include selectively opening any suitable selected electrically actuated gas lift valve assembly in the plurality of electrically actuated gas lift valve assemblies. This may include selectively transitioning the selected electrically actuated gas lift valve assembly to the open state and/or selectively permitting fluid flow from the lift gas supply conduit to the production conduit via a gas injection conduit of the selected electrically actuated gas lift valve assembly.

The selectively opening may be based, at least in part, on the respective pressure differential measured by, or at, the selected electrically actuated gas lift valve assembly and may be accomplished in any suitable manner. As an example, and when methods 200 include the determining at 220, the generating at 225, and/or the providing at 230, the selectively opening at 235 may include selectively opening responsive to receipt of the respective valve state signal from the controller and/or by the selected electrically actuated gas lift valve assembly.

As another example, the selectively opening at 235 may include selectively opening responsive to the respective pressure differential, as measured at and/or by the selected electrically actuated gas lift valve assembly, exceeding a threshold pressure differential and/or being a closest respective pressure differential to the threshold pressure differential. As yet another example, the selectively opening at 235 may include selectively opening a most downhole electrically actuated gas lift valve assembly in the plurality of electrically actuated gas lift valve assemblies when the respective pressure differential exceeds the threshold pressure differential and/or is within a predetermined pressure differential range.

As another example, the selectively opening at 235 may include electrically selecting the selected electrically actuated gas lift valve by providing an assembly-specific electric signal to the selected electrically actuated gas lift valve. As yet another example, the selectively opening at 235 may include commanding, or selectively commanding, the selected electrically actuated gas lift valve assembly to accept an electric current. As another example, the selectively opening at 235 may include transitioning the selectively actuated gas lift valve assembly to the open state.

It is within the scope of the present disclosure that the selectively opening at 235 may be based, at least in part, on one or more additional criteria that may be in addition to the respective pressure differential measured at the selected electrically actuated gas lift valve assembly. As an example, the selectively opening at 235 may include selectively opening based, at least in part, on a pressure differential measured at another electrically actuated gas lift valve assembly, on a production rate of fluid from the hydrocarbon well, on a flow rate of the lift gas stream through the hydrocarbon well, on a flow rate of the lift gas stream through the selected electrically actuated gas lift valve assembly, on an expected flow rate of the lift gas stream through the selected electrically actuated gas lift valve assembly, on a pressure that is measured downhole from the selected electrically actuated gas lift valve assembly, on a pressure differential that is measured downhole from the selected electrically actuated gas lift valve assembly, on a bottom hole pressure of the hydrocarbon well, and/or on a pressure differential between the tubing conduit and the annular space measured near a toe end of the hydrocarbon well.

It is also within the scope of the present disclosure that the selected electrically actuated gas lift valve assembly may be a first selected electrically actuated gas lift valve assembly in a plurality of selected electrically actuated gas lift valve assemblies. Under these conditions, the selectively opening at 235 may include selectively opening the plurality of selected electrically actuated gas lift valve assemblies.

Calculating the injection rate at 240 may include calculating the injection rate of the lift gas stream through the selected electrically actuated gas lift valve assembly. The calculating at 240 may be based, at least in part, on the respective pressure differential and/or on a cross-sectional area of an orifice portion of the selected electrically actuated gas lift valve assembly.

Adjusting the injection rate at 245 may include adjusting the injection rate of the lift gas stream through the selected electrically actuated gas lift valve assembly. The adjusting at 245 may include adjusting to maintain the injection rate within a target injection rate range and/or to maintain a gas-to-liquid ratio in the production conduit within a target gas-to-liquid ratio range. The adjusting at 245 may include adjusting with, via, and/or utilizing an adjustable valve assembly orifice, such as adjustable valve assembly orifice 124 of FIGS. 2-4.

Retaining other electrically actuated gas lift valve assemblies in the respective closed state at 250 may include retaining each other electrically actuated gas lift valve assembly in the plurality of electrically actuated gas lift valve assemblies in a respective closed state. Stated another way, methods 200 may include providing the lift gas stream from the lift gas supply conduit and/or to the production conduit only through the selected electrically actuated gas lift valve assembly and/or providing the lift gas stream only through a single selected electrically actuated gas lift valve assembly.

Providing the lift gas stream via the selected electrically actuated gas lift valve assembly at 255 may include providing the lift gas stream to the production conduit and/or from the lift gas supply conduit. This may include flowing the lift gas stream through the gas injection conduit of the selected electrically actuated gas lift valve assembly.

Selectively regulating the open cross-sectional area of the orifice portion of the gas injection conduit at 260 may include selectively regulating the open cross-sectional area based, at least in part, on the respective pressure differential. This may include selectively regulating the open cross-sectional area to facilitate, or as part of, the adjusting at 245. The selectively regulating at 260 may include selectively regulating to regulate the flow rate of the lift gas stream through the selected electrically actuated gas lift valve assembly and/or to maintain the flow rate within a predetermined flow rate range.

Measuring the respective pressure differential at 265 may include performing, or repeating, the measuring at 210 to measure the respective pressure differential at each electrically actuated gas lift valve assembly. Stated another way, the measuring at 265, which also may be referred to herein as repeating the measuring at 210, may include measuring the respective pressure differential at a point in time that is subsequent to a point in time at which the measuring at 210 was performed.

Selectively opening another electrically actuated gas lift valve assembly at 270 may include selectively opening the other electrically actuated gas lift valve assembly based, at least in part, on a change in the respective pressure differential. Stated another way, and responsive to a change in the respective pressure differential between the measuring at 210 and the measuring at 265, the selectively opening at 270 may include selectively opening another electrically actuated gas lift valve assembly that is different from the selected electrically actuated gas lift valve assembly. When methods 200 include the selectively opening at 270, methods 200 also may include closing the selected electrically actuated gas lift valve assembly, and the closing may be performed prior to, concurrently with, and/or subsequent to the selectively opening at 270.

Providing the gas lift stream via the other electrically actuated gas lift valve assembly at 275 may include providing the lift gas stream from the lift gas supply conduit and/or to the production conduit via the other selectively actuated lift gas valve assembly. This may include flowing the lift gas stream through the gas injection conduit of the other electrically actuated gas lift valve assembly.

As discussed, electrically actuated gas lift valve assemblies according to the present disclosure may be individually and/or selectively addressed and/or actuated. With this in mind, it is within the scope of the present disclosure that the electrically actuated gas lift valve assemblies may be utilized and/or controlled in a manner that may be in addition to, or in place of, those described herein.

As an example, and prior to initiating gas lift within a hydrocarbon well, both the tubing conduit and the annular space may be filled with a liquid. Upon initiating flow of the lift gas stream to the lift gas supply conduit, the lift gas stream may pressurize the lift gas supply conduit, thereby providing a motive force for flow of the liquid from the lift gas supply conduit. To speed and/or facilitate flow of this liquid from the lift gas supply conduit, a selected subset, or even every, electrically actuated gas lift valve assembly within the hydrocarbon well may be transitioned to the open state.

As another example, electrically actuated gas lift valve assemblies that are downhole from an upper level of the liquid that is within the lift gas supply conduit may be transitioned to the open state. Additionally or alternatively, electrically actuated gas lift valve assemblies that are uphole from the upper level of the liquid that is within the lift gas supply conduit may be transitioned to the closed state. This process may be referred to herein as unloading the lift gas supply conduit.

As yet another example, and as discussed herein, methods 200 may include measuring the respective pressure differential at 210 and calculating the injection rate at 240. By monitoring a relationship, or a correlation, between the pressure differential across a given electrically actuated gas lift valve assembly and the injection rate through the given electrically actuated gas lift valve assembly, variation in a resistance to fluid flow through the gas injection conduit of the given electrically actuated gas lift valve assembly may be estimated and/or quantified.

As an example, it may be observed that the injection rate through the given electrically actuated gas lift valve assembly increases as a function of time for a given pressure differential across the given electrically actuated gas lift valve assembly. This may indicate a decrease in resistance to fluid flow through the gas injection conduit, erosion of the structures that define the gas injection conduit, and/or an increase in a volume of the gas injection conduit. This information may indicate wear of the given electrically actuated gas lift valve assembly, may indicate a need to replace the given electrically actuated gas lift valve assembly, and/or may be utilized to more accurately regulate flow of the lift gas stream through the given electrically actuated gas lift valve assembly.

As another example, it may be observed that the injection rate through the given electrically actuated gas lift valve assembly decreases as a function of time for a given pressure differential across the given electrically actuated gas lift valve assembly. This may indicate an increase in resistance to fluid flow though the gas injection conduit, corrosion of the structures that define the gas injection conduit, accumulation of foreign material within the gas injection conduit, and/or a decrease in the volume of the gas injection conduit. This information may indicate plugging of the given electrically actuated gas lift valve assembly, may indicate a need to clean the given electrically actuated gas lift valve assembly, and/or may be utilized to more accurately regulate flow of the lift gas stream through the given electrically actuated gas lift valve assembly.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A hydrocarbon well, comprising:

a wellbore that extends within a subterranean formation;

downhole tubing that extends within the wellbore and defines a tubing conduit, wherein the wellbore and the downhole tubing together define an annular space therebetween, and further wherein one of the tubing conduit and the annular space defines a production conduit configured to produce a reservoir fluid from the subterranean formation;

a lift gas supply system configured to provide a lift gas stream to a lift gas supply conduit that is defined by the tubing conduit and the annular space;

a plurality of electrically actuated gas lift valve assemblies spaced apart along a length of the downhole tubing, wherein each electrically actuated gas lift valve assembly in the plurality of electrically actuated gas lift valve assemblies includes:

(i) a gas injection conduit extending between the production conduit and the lift gas supply conduit;

(ii) a valve assembly orifice that defines an orifice portion of the gas injection conduit; and (iii) an electrically actuated shut-off valve that defines a valve portion of the gas injection conduit and is configured to be selectively and electrically actuated between an open state, in which the electrically actuated shut-off valve permits fluid flow through the gas injection conduit, and a closed state, in which the electrically actuated shut-off valve restricts fluid flow through the gas injection conduit;

a valve power supply system configured to supply an electric current to electrically power the plurality of electrically actuated gas lift valve assemblies; and a controller programmed to selectively provide a respective control signal to each electrically actuated gas lift valve assembly to control the plurality of electrically actuated gas lift valve assemblies; and wherein the controller is programmed to independently transition the electrically actuated shut-off valve of each electrically actuated gas lift valve assembly between the open state and the closed state based, at least in part, on a corresponding pressure differential measured by the electrically actuated gas lift valve assembly.

2. The hydrocarbon well of claim 1, wherein the electrically actuated shut-off valve is a binary valve configured to define only the open state and the closed state.

3. The hydrocarbon well of claim 1, wherein each electrically actuated gas lift valve assembly further includes a check valve that defines a check valve portion of the gas injection conduit, wherein the check valve is configured to permit fluid flow, via the gas injection conduit, from the lift gas supply conduit to the production conduit and to restrict fluid flow, via the gas injection conduit, from the production conduit to the lift gas supply conduit.

4. The hydrocarbon well of claim 1, wherein the valve assembly orifice is a fixed-size valve assembly orifice.

5. The hydrocarbon well of claim 1, wherein the valve assembly orifice is an adjustable valve assembly orifice configured to be selectively and electrically transitioned among a plurality of orifice sizes between a minimum orifice size and a maximum orifice size, and further wherein the respective control signal includes an orifice size signal that specifies a selected orifice size for the adjustable valve assembly orifice, and further wherein, responsive to receipt of the orifice size signal, the adjustable valve assembly orifice is configured to transition to the selected orifice size.

6. The hydrocarbon well of claim 1, wherein each electrically actuated gas lift valve assembly further includes a differential pressure sensor configured to detect a pressure differential between the lift gas supply conduit and the production conduit, wherein the differential pressure sensor is configured to generate a pressure differential sensor signal, which is indicative of the pressure differential, and provide the pressure differential sensor signal to the controller, and further wherein the controller is programmed to selectively transition the electrically actuated shut-off valve of each electrically actuated gas lift valve assembly between the open state and the closed state based, at least in part, on the pressure differential.

7. The hydrocarbon well of claim 6, wherein the controller is programmed to independently transition the electrically actuated shut-off valve of each electrically actuated gas lift valve assembly between the open state and the closed state based, at least in part, on a corresponding pressure differential that is associated with each electrically actuated gas lift valve assembly.

8. The hydrocarbon well of claim 6, wherein the controller is programmed to calculate an injection rate of the lift gas stream into the production conduit, via the gas injection conduit, based, at least in part, on the pressure differential and a cross-sectional area of the orifice portion of the gas injection conduit.

9. The hydrocarbon well of claim 8, wherein the controller is programmed to adjust the injection rate to at least one of:

(i) maintain the injection rate within a target injection rate range; and (ii) maintain a gas-to-liquid ratio in the production conduit within a target gas-to-liquid ratio range.

10. The hydrocarbon well of claim 1, wherein each electrically actuated gas lift valve assembly further includes a flow sensor configured to detect a flow rate of the lift gas stream through the gas injection conduit.

11. The hydrocarbon well of claim 1, wherein the hydrocarbon well further includes a high pressure bypass assembly configured to equalize pressure between the production conduit and the lift gas supply conduit responsive to the pressure differential between the production conduit and the lift gas supply conduit exceeding a threshold maximum pressure differential, wherein the high pressure bypass assembly is positioned downhole from the plurality of electrically actuated gas lift valve assemblies.

12. A method of providing gas lift in the hydrocarbon well of claim 1, the method comprising:

providing the lift gas stream to the lift gas supply conduit;

measuring a respective pressure differential between the lift gas supply conduit and the production conduit at each electrically actuated gas lift valve assembly;

selectively opening a selected electrically actuated gas lift valve assembly in the plurality of electrically actuated gas lift valve assemblies based, at least in part, on the respective pressure differential measured at the selected electrically actuated gas lift valve assembly; and providing the lift gas stream to the production conduit via the selected electrically actuated gas lift valve assembly.

13. The method of claim 12, wherein the method further includes:

(i) repeating the measuring;

(ii) closing the selected electrically actuated gas lift valve assembly based, at least in part, on a change in the respective pressure differential;

(iii) selectively opening another electrically actuated gas lift valve assembly in the plurality of electrically actuated gas lift valve assemblies based, at least in part, on the change in the respective pressure differential; and providing the lift gas stream to the production conduit via the other electrically actuated gas lift valve assembly.

14. The method of claim 12, wherein the method further includes selectively regulating an open cross-sectional area of the orifice portion of the gas injection conduit of the selected electrically actuated gas lift valve assembly based, at least in part, on the respective pressure differential.

* * * * *